US005996818A

United States Patent [19]

Boje et al.

[11] Patent Number: 5,996,818

[45] Date of Patent: Dec. 7, 1999

[54] SPECIMEN TUBE RACK

[75] Inventors: John F. Boje, Omaha; Samuel R. Brown, Bellevue; J. Michael Seaton, Omaha, all of Nebr.

[73] Assignee: Lab-Interlink, Inc., Omaha, Nebr.

[21] Appl. No.: 09/198,638

[22] Filed: Nov. 24, 1998

[51] Int. Cl.[6] ..... A47F 7/00

[52] U.S. Cl. ..... 211/74; 422/104; 206/443

[58] Field of Search ..... 211/74, 60.1, 89.01, 211/72; 422/104; 206/443

[56] References Cited

U.S. PATENT DOCUMENTS

| | | | |
|---|---|---|---|
| 4,281,768 | 8/1981 | Sommers | 211/74 |
| 4,284,603 | 8/1981 | Korom | 211/74 X |
| 4,807,421 | 2/1989 | Araki et al. | 211/89.01 X |
| 5,080,232 | 1/1992 | Leoncavallo et al. | 211/74 X |
| 5,133,939 | 7/1992 | Mahe | 211/74 X |
| 5,169,603 | 12/1992 | Landsberger | 211/74 X |
| 5,267,660 | 12/1993 | Kwon | 211/70.2 |
| 5,579,929 | 12/1996 | Schwartz | 211/74 |
| 5,632,388 | 5/1997 | Morrison et al. | 211/74 |
| 5,642,816 | 7/1997 | Kelly et al. | 211/74 X |

*Primary Examiner*—Robert W. Gibson, Jr.

*Attorney, Agent, or Firm*—Koley, Jessen, Daubman & Rupiper, P.C.; Mark D. Frederiksen

[57] ABSTRACT

A specimen tube storage rack includes a hollow housing having a plurality of wells formed in the top wall and extending into the interior of the housing. An assembly of three parallel plates is mounted in an upper portion of the housing, with the top plate forming the top wall of the housing. Each plate has a plurality of openings formed therein which are vertically coaxial to form the wells. A pair of sheets of resilient flexible material are compressed between pairs of plates, and include a plurality of apertures coaxial with the openings in the plates. The apertures in the sheets have cuts extending radially outwardly into the sheet, to form flaps surrounding each aperture. The compression of each sheet between a pair of plates urges the flaps to a generally coplanar position. The apertures in the sheets are smaller in diameter than the openings in the plates, and smaller in diameter than the test tubes inserted into the wells, such that the flaps will be bent downwardly as the test tubes are inserted in each well. The urging of the flaps to a coplanar position thereby exerts a biasing force on the test tubes to center and plumb the test tubes, and to apply a restraining force against removal of the test tubes from the wells.

6 Claims, 3 Drawing Sheets

SPECIMEN TUBE RACK

TECHNICAL FIELD

The present invention relates generally to laboratory conveyor systems, and more particularly to an improved rack for storage of specimen tubes within a laboratory organizer unit.

BACKGROUND OF THE INVENTION

Automated laboratory conveyor systems are utilized to transport various types of specimens between various work stations, and a storage or archive area. In order to provide efficient and effective storage, various types of storage racks have been provided in the prior art, for supporting a plurality of specimen tubes in spaced apart vertical orientation, for storage and retrieval by a robotic arm.

These prior art storage racks suffer several problems. The conventional prior art rack consists of a plurality of holes or "wells" formed in a solid piece of material or in a wire mesh. In order to permit a robotic arm to easily place a specimen tube within each well, the diameter of the well must be sufficiently greater in diameter than the diameter of the specimen tube to permit placement, even if the robotic arm is not directly aligned above the well. However, the hole cannot be increased in diameter without effecting the storage position of the specimen tube within the well. If the well diameter is too great, the specimen tube will be tipped to one side, and will be difficult to retrieve by the robotic arm. Thus, the size of the well diameter in conventional racks is limited by the amount of angular displacement from vertical which is permitted by the particular robotic arm to retrieve a specimen tube within the well.

A related problem concerns containment of spillage from a specimen tube which is cracked or damaged within the rack. A sufficient amount of space around the entire cylindrical surface of the specimen tube is desirable, so that any spillage is retained within the well supporting the tube. Thus, a large diameter well is preferable to a well having a diameter which is only slightly greater than the diameter of the specimen tube. In addition, it is desirable to have the specimen tube centered within the well, rather than leaning against a side of the well, such that spillage from a location above the upper surface of the rack will run down the side of the specimen tube and into the well, rather than on to the top of the rack.

Finally, storage racks are conventionally transported within a storage unit, or between storage units and conveyor systems. Any movement of the rack permits the possibility of tipping or inverting of the rack. Unless the specimen tubes are restrained within the rack in some fashion, they are susceptible of falling out of the rack and becoming either lost or broken.

SUMMARY OF THE INVENTION

It is therefore a general object of the present invention to provide an improved rack for storage of specimen tubes.

Another object is to provide a specimen rack which has wells for receiving and retaining specimen tubes which will automatically plumb a specimen tube placed within the well, to a vertical orientation.

A further object of the present invention is to provide a specimen rack with a plurality of wells which will center a specimen tube within the diameter of the well, spaced from the side walls of the well.

Yet another object is to provide a specimen rack with wells having a greater diameter than the specimen tubes placed therein, yet self-centering and self-plumbing features to permit easy retrieval by a robotic arm.

Still a further object of the present invention is to provide a rack for specimen tubes which permits easy entry of the specimen tubes within the rack, but provides a gripping force to retain the specimen tubes within the rack if the rack is inverted, yet permits easy removal of the tubes from the rack by a robotic arm.

These and other objects will be apparent to those skilled in the art.

The specimen tube storage rack of the present invention includes a hollow housing having a plurality of wells formed in the top wall and extending into the interior of the housing. An assembly of three parallel plates is mounted in an upper portion of the housing, with the top plate forming the top wall of the housing. Each plate has a plurality of openings formed therein which are vertically coaxial to form the wells. A pair of sheets of resilient flexible material are compressed between pairs of plates, and include a plurality of apertures coaxial with the openings in the plates. The apertures in the sheets have cuts extending radially outwardly into the sheet, to form flaps surrounding each aperture. The compression of each sheet between a pair of plates urges the flaps to a generally coplanar position. The apertures in the sheets are smaller in diameter than the openings in the plates, and smaller in diameter than the test tubes inserted into the wells, such that the flaps will be bent downwardly as the test tubes are inserted in each well. The urging of the flaps to a coplanar position thereby exerts a biasing force on the test tubes to center and plumb the test tubes, and to apply a restraining force against removal of the test tubes from the wells.

DESCRIPTION OF THE PREFERRED EMBODIMENT

Figure 1:
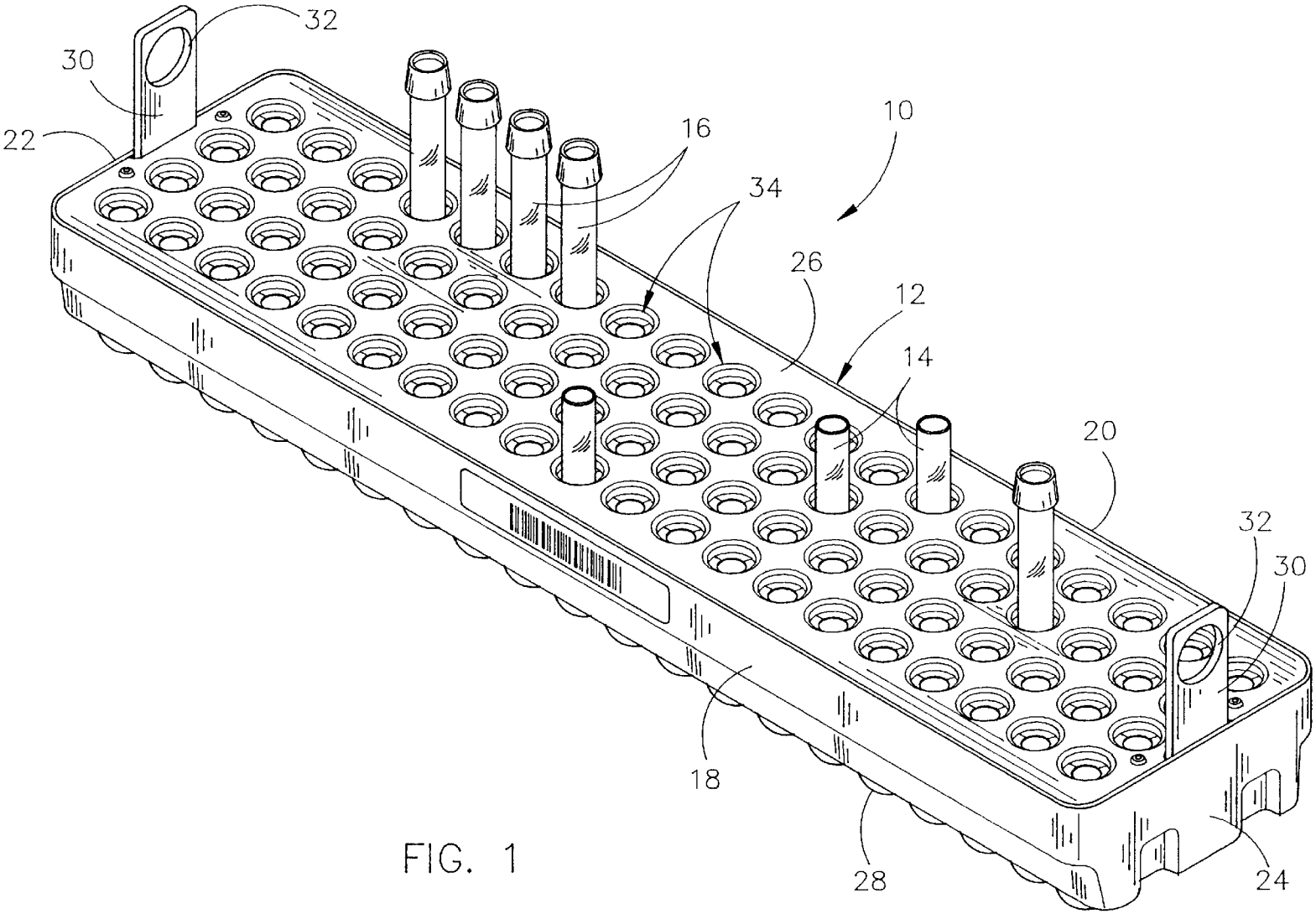
FIG. 1 is a perspective view of the rack of the present invention.

Referring now to the drawings, in which similar or corresponding parts are identified with the same reference numeral, and more particularly to FIG. 1, the specimen tube rack of the present invention is designated generally at 10 and includes a housing 12 for supporting a plurality of test tubes 14 and 16 of various types and sizes.

Housing 12 is hollow and enclosed, and includes forward and rearward walls 18 and 20 and walls 22 and 24, and top and bottom walls 26 and 28. A pair of hangers 30 project upwardly from end walls 22 and 24, and include coaxial apertures 32 therethrough, which permit the housing 12 to be suspended on hangers 30. A plurality of wells 34 are formed in the top wall 26, and extend downwardly into housing 12, each well 34 adapted to receive a test tube 14 or 16.

Figure 2:
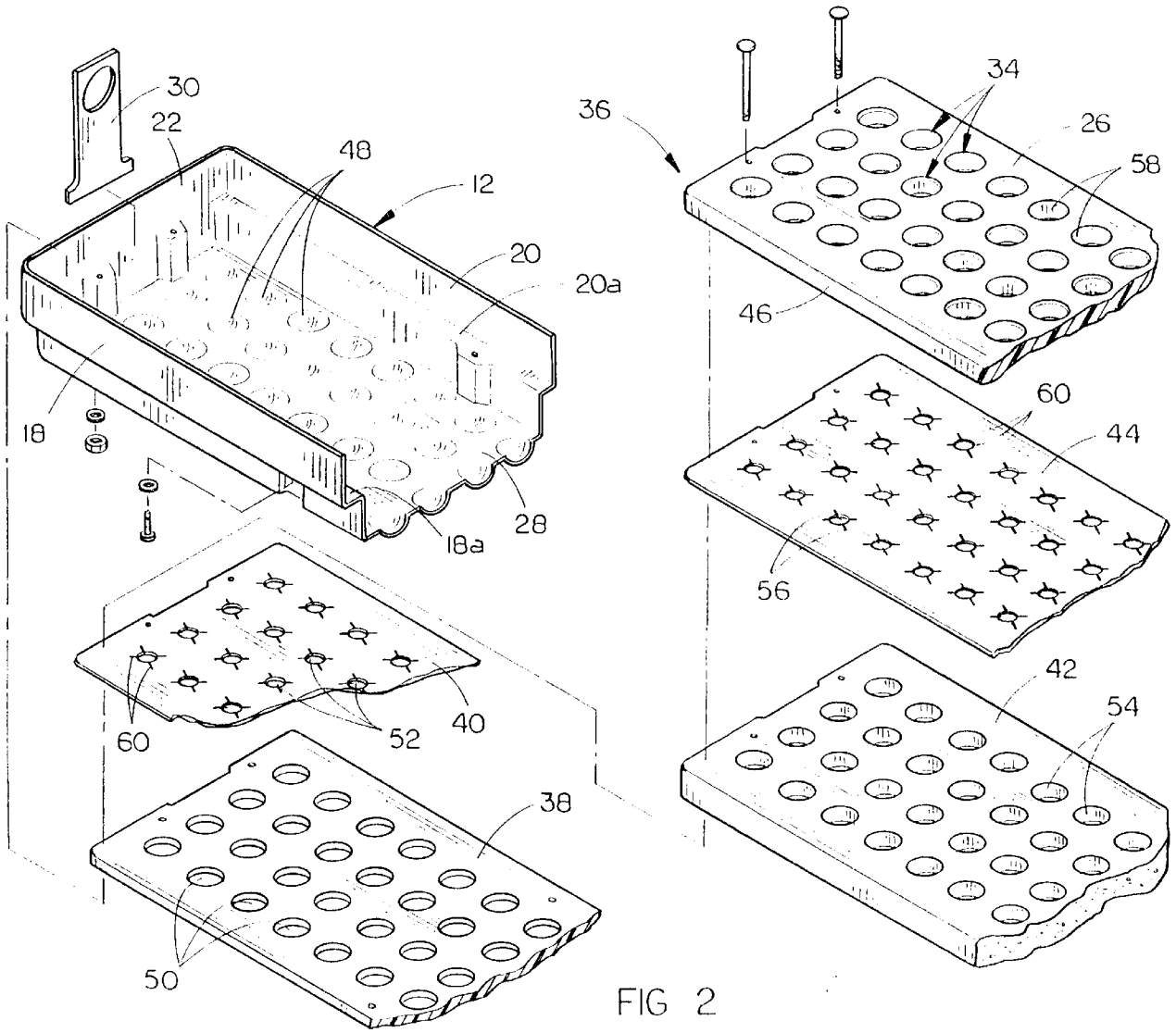
FIG. 2 is a partial exploded perspective view of the invention.

Referring now to FIG. 2, it can be seen that forward and rearward walls 18 and 20 have an interiorly projecting ledge 18*a* and 20*a* respectively extending along their lengths generally midway between the upper and lower edges thereof. FIG. 2 also shows top wall 26 to be an assembly 36 of five stacked plates 38, 40, 42, 44, and 46. Assembly 36 is supported on ledges 18*a* and 20*a* such that top wall 26 is generally flush with the upper edges of forward and rearward walls 18 and 20. Bottom wall 28 has a plurality of spaced apart generally semispherical depressions 48 formed therein which form the bottom of wells 34. The bottom plate 38 of assembly 36 includes a plurality of openings 50 therein which are aligned vertically with depressions 48. Second plate 40 is coextensive with bottom plate 38, and rests atop bottom plate 38, and includes a plurality of apertures 52 which are coaxial with openings 50 and depressions 48. Sheet 40 is preferably formed of a flexible, resilient and compressible material.

Third plate 42 is coextensive with second plate 40 and includes a plurality of openings 54 coaxial with openings 50 and apertures 52 in the first and second plates 38 and 40. Fourth plate 44 is coextensive with third plate 42, and rests on top of third plate 42. Fourth plate 44 is a sheet of resilient compressible material, the same as plate 40, and includes the same apertures 56, therethrough, coaxial with apertures 52 in plate 40. Thus, third plate 42 acts as a spacer between sheets 40 and 44.

Finally, fifth plate 46 is the top plate of assembly 36, and is coextensive with fourth plate 44. Openings 58 in top plate 46 are coaxial with openings 54 and third plate 42 and openings 50 in bottom plate 38, and preferably have the same diameter as the openings in first and third plates 38 and 42. Each well 34 is therefore comprised of a bottom formed by a depression 48 in bottom wall 28, and side walls formed by openings 50, 54, and 58 in plates 38, 42, and 46 respectively.

Each aperture 52 and 56 in sheets 40 and 44 has a plurality of cuts 60 extending radially outwardly into the sheets from the apertures. Cuts 60 thereby form flaps 62 around each aperture 52 and 56.

Figure 3:
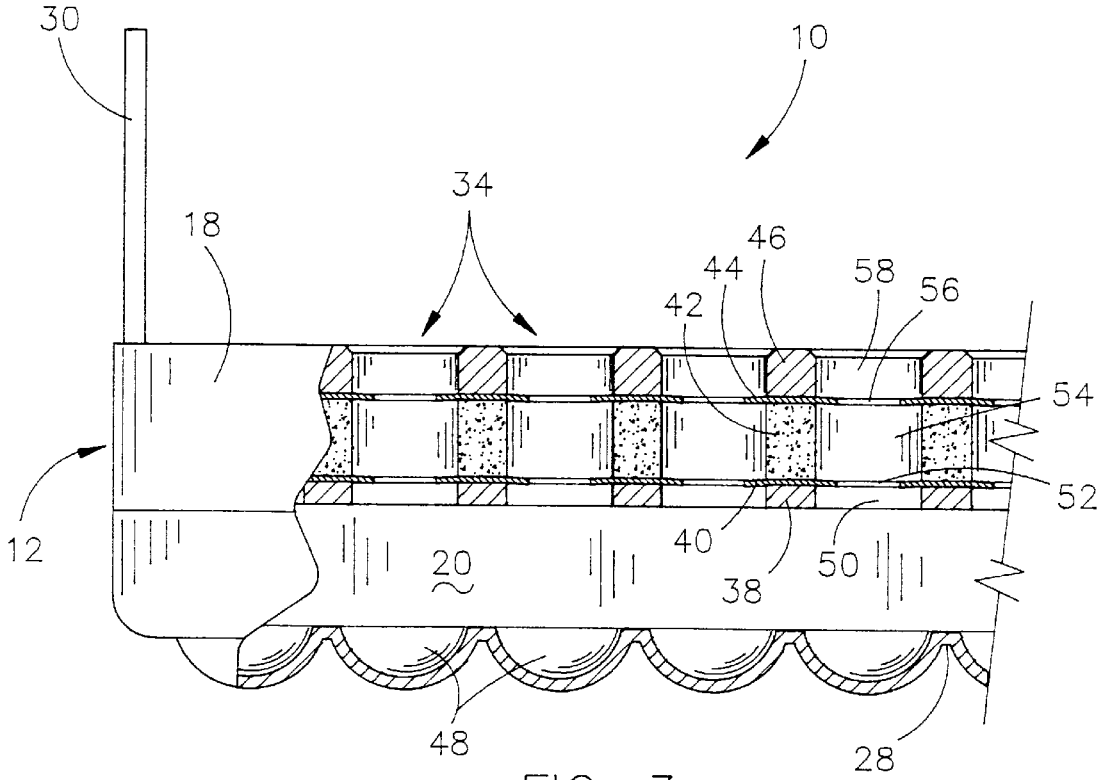
FIG. 3 is an enlarged front elevational view of one portion of the rack, with a portion shown in section.
Figure 4:
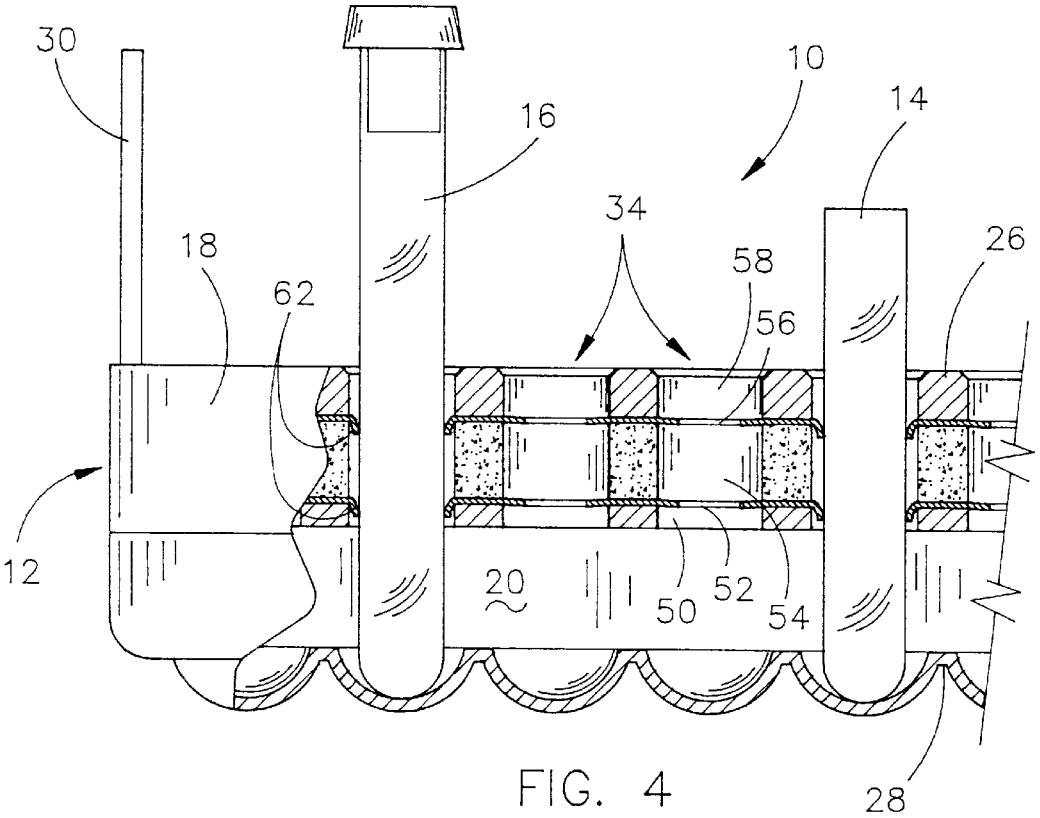
FIG. 4 is a view similar to FIG. 3, but with a pair of specimen tubes installed within two wells of the rack.

Referring now to FIGS. 3 and 4, it can be seen that apertures 52 and 56 in sheets 40 and 44 have diameters which are less than the diameters of openings 50, 54, and 58 in plates 38, 42, and 46 respectively. As shown in FIG. 4, the diameter of apertures 52 and 56 is less than the diameter of test tubes 14 and 16, while the diameters of openings 50, 54, and 58 are greater than the diameters of test tubes 14 and 16. In this way, the insertion of test tubes 14 and 16 into a well 34 will cause flaps 62 to deflect downwardly within each well 34 in frictional engagement with the cylindrical side wall of the test tube 14 and 16. Because sheets 40 and 44 are compressed between plates 38, 42 and 46, the flaps 62 will be urged to a generally coplanar position, which in turn will bias the test tube 14 and 16 to a vertical plumb position generally centered within the well 34, and spaced from the side walls of openings 50, 54, and 58.

In addition, sheets 40 and 44 preferably formed of a sponge-like material which will frictionally engage the glass or plastic surface of test tubes 14 and 16. The resilient flexible characteristics of flaps 62 will thereby create a frictional force which resists upward movement of the test tubes 14 and 16 yet permits easy insertion of the test tubes within each well 34. This frictional grouping of the test tubes prevents accidental release of the test tubes if the housing 12 is inverted, yet permits removal of the test tubes upon the application of an upwardly directed force of sufficient magnitude.

Whereas the specimen tube rack of the present invention has been shown and described in connection with the preferred embodiment thereof, many modification, substitutions and additions may be made which are within the intended broad scope of the appended claims.

We claim:

1. A rack for storage of a plurality of specimen tubes, comprising:

a housing with a hollow interior enclosed with top and bottom walls, forward and rearward walls, and opposing end walls;

a plurality of openings formed in the top wall, communicating with the housing interior;

a first sheet of flexible, resilient material mounted parallel to the top wall within the housing interior and extending substantially co-extensive with the top wall, said sheet having a plurality of apertures therein vertically aligned with the top wall openings and having diameters less than the diameters of the top wall openings;

a second sheet of flexible, resilient material mounted parallel to and spaced from the first sheet, with apertures vertically aligned with and equal in diameter to the first sheet apertures; and a plate mounted parallel to the top wall and between the sheets to space the sheets apart from one another, said plate extending substantially co-extensively with the top wall and sheets and having a plurality of openings therein vertically aligned with the top wall openings;

said sheets and plate adapted to retain a test tube centered and generally vertical and plumb within the openings, and applying a resisting force to a test tube within the openings and apertures to restrain the test tube against withdrawal therefrom.

2. The rack of claim 1, wherein each sheet aperture has a plurality of cuts extending radially outwardly into the sheet to form a plurality of flaps surrounding each aperture.

3. The rack of claim 2, wherein said sheet is formed of a sponge-like material which will frictionally engage glass and plastic.

4. The rack of claim 1 further comprising a bottom plate mounted parallel to and spaced from the plate within the housing interior and extending substantially co-extensively with the plate, said bottom plate having a plurality of openings therein vertically aligned with the top wall and plate openings.

5. The rack of claim 4, wherein the first sheet is compressed between the top wall and plate to urge the first sheet flaps to a generally coplanar condition, and wherein the second sheet is compressed between the plate and bottom plate to urge the second sheet flap to a generally coplanar condition.

6. The rack of claim 5, wherein said bottom wall includes an upper surface within the housing interior, and further comprising a plurality of depressions formed in the bottom wall upper surface vertically aligned with the openings and the plates and forming a bottom of each well.

* * * * *